United States Patent [19]

Allen

[11] Patent Number: 4,941,335

[45] Date of Patent: Jul. 17, 1990

[54] COMBINATION KEY AND KEY HOLDER

[75] Inventor: Bobby H. Allen, Louisville, Ky.

[73] Assignee: Mitsubishi Corporation, Tokyo, Japan

[21] Appl. No.: 189,954

[22] Filed: May 3, 1988

[51] Int. Cl.[5] ..... A47G 29/10

[52] U.S. Cl. ..... 70/458; 70/459

[58] Field of Search ..... 70/456–459, 70/395, 406; D3/61, 62; 206/37–37.8; 24/3 K, 623, 625; 40/2 A, 330

[56] References Cited

U.S. PATENT DOCUMENTS

| | | | |
|---|---|---|---|
| 2,714,304 | 2/1955 | Dedda | 70/406 |
| 2,734,624 | 2/1956 | Kernicki | 206/38 |
| 3,541,818 | 11/1970 | Dana | 70/393 |
| 3,606,777 | 9/1971 | Watson | 70/458 |
| 3,933,017 | 1/1976 | Shee | 70/456 R |
| 4,454,737 | 6/1984 | Toyoda | 70/456 R |
| 4,637,236 | 7/1987 | Almblad | 70/458 |
| 4,677,835 | 1/1987 | Almblad | 70/456 R |

FOREIGN PATENT DOCUMENTS

| | | |
|---|---|---|
| 134982 | 10/1983 | Japan . |
| 58-50035 | 11/1983 | Japan . |
| 934838 | 8/1963 | United Kingdom . |

*Primary Examiner*—Robert L. Wolfe

*Attorney, Agent, or Firm*—Cahill, Sutton & Thomas

[57] ABSTRACT

A plastic combination key and key holder wherein the key holder is a card-shaped plastic body having at least one key-shaped recess or opening therein with a portion thereof not extending entirely through the holder and having a projecting bulbous head snap pin. The key is a molded plastic key having a head portion which has a reduced thickness portion with an opening therethrough. The opening is dimensioned to mate with the holder projection to allow the key to be snapped onto the holder and to be snapped off of the holder with the reduced thickness portion of the head overlying the portion of the holder having the projecting pin.

13 Claims, 1 Drawing Sheet

COMBINATION KEY AND KEY HOLDER

BACKGROUND OF THE INVENTION

1. Field of the Invention

This invention relates to keys and more particularly to a molded plastic key and holder combination.

2. Prior Art

Molded plastic key and holder combinations have recently become popularized. Generally, the holder is a plastic body member generally approximately the shape of a credit card which is provided with one or more generally key-shaped recesses in which a molded plastic key is carried attached to the holder. Various forms of attachment have been proposed, including molding the key in situ as a part of the card as shown in Donald Almblad U.S. Pat. No. 4,637,236, molding the key separately and snapping it in and out of the card recess, as shown in the same patent, and molding the key attached to the card through a flexible, bendable attachment shank, as shown in the patent to Robert Almblad, U.S. Pat. No. 4,677,835. While such devices have been successful, this invention discloses an alternative construction where the key and the holder may be easily and conveniently fastened together and separated apart by means of a pop-snap type connection while retaining the overall convenience of molded plastic keys and molded plastic holders of the type which may be conveniently carried in a wallet or purse.

Molded plastic snap connectors have also been known, such as are used for fastening children's garments. Generally, such snap connectors include a male headed snap member and a female mating snap connector, each of which is molded of plastic. The male headed member includes a bulbous headed portion and the female member includes a tapered opening with one or both of the members having sufficient resiliency to allow the male member to be snapped into the female member and to be unsnapped therefrom. It has not been previously proposed to integrally mold such fasteners as a part of a key and holder combination.

It is therefore a principal object of this invention to provide a snap-together, snap-apart key and card combination.

It is a more particular object of this invention to provide a snap-together, snap-apart key and card combination where the card and key are each molded of plastic and where the card contains a recess generally dimensioned to receive the key.

It is another, and particular, object of this invention to provide a molded plastic key and card shaped holder wherein each of the key and the card have a part thickness ledged area with the ledged areas overlappable and with mutually engageable and disengageable snap connections molded in place in the overlapping areas.

It is another, and particular, object of this invention to provide a molded plastic key and holder combination utilizing a generally card-shaped holder with at least one generally keyshaped opening therethrough and with a reduced thickness portion bordering the opening, with the key formed with a head portion having a reduced thickness portion adapted to overlap the reduced thickness portion of the holder with the key positioned in the opening, and the reduced thickness portions having mating, engageable and disengageable molded snap connection elements.

SUMMARY OF THE INVENTION

My invention provides a combination molded plastic key and holder wherein the holder may be conveniently molded in a card shape. Preferably, the holder is relatively thin, having generally the overall dimensions of a credit card with a maximum thickness generally approaching the standard thickness of metal keys. The card is molded of a plastic having sufficient resiliency to be conveniently used in wallet but sufficient stiffness to provide a holder for a key. An opening or recess is molded through the holder and is generally key-shaped in its outline. Adjacent the key-shaped opening or recess, a portion of the holder is formed with reduced thickness providing a stepped ledge from the opening to the main thickness. A molded plastic key is provided having a head-end, including a stepped thickness portion at an edge thereof. Ideally, the step thickness portion of the key head and the step thickness portion of the holder are dimensioned such that they can be overlapped, having a combined stack height equal to or less than the major thickness of the holder or key. The two reduced thickness portions are juxtaposed such that when overlapped, the key is received in the key-shaped opening. The reduced thickness portions are provided with molded in place mating male and female snap connector portions allowing the key to be snapped into position on the holder and to be separated from the holder by a snap release movement.

DESCRIPTION OF THE PREFERRED EMBODIMENT

Figure 1:
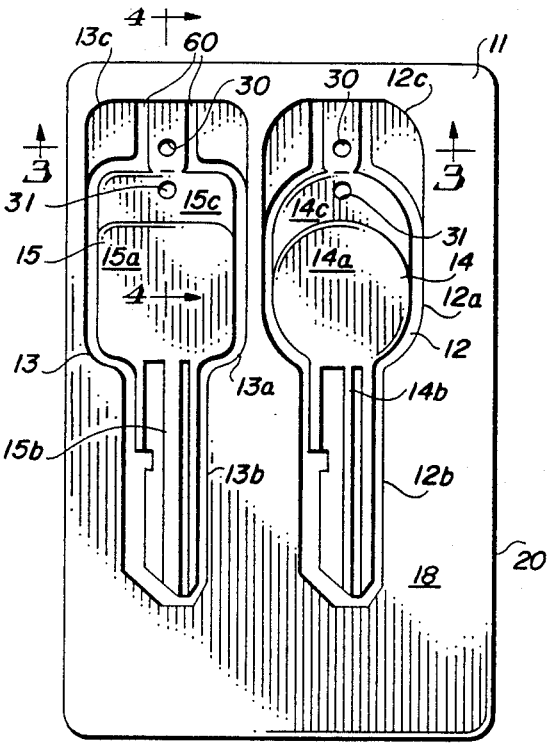
FIG. 1 is a top elevational view of a molded plastic key and holder combination according to this invention.
Figure 2:
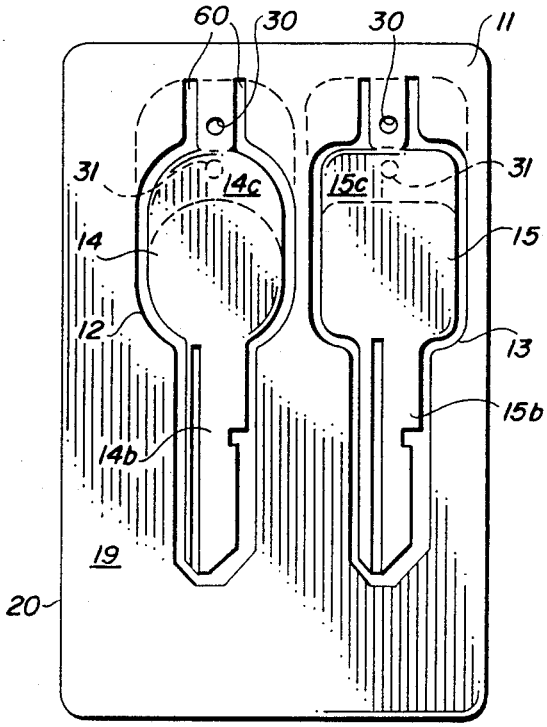
FIG. 2 is a bottom elevational view of the combination of FIG. 1 showing the reduced thickness portions by broken lines.
Figure 3:
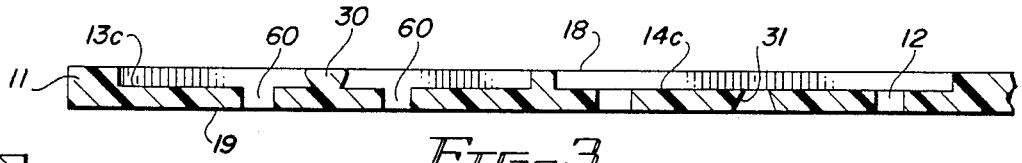
FIG. 3 is an enlarged fragmentary cross-section taken along the lines II—II of FIG. 1.

As best illustrated in FIGS. 1 and 2, this invention discloses a plastic combination key and holder which, for purposes of illustration, is shown as comprising a holder base 11 having a pair of recesses therein 12, 13 which contain key blanks 14, 15.

The holder 11 is formed of molded plastic and may preferably be generally in the shape of a standard credit card having a top face 18 and a bottom face 19 with a surrounding peripheral edge 20. The holder is generally rectangular and may have rounded corners 22. The recesses 12 and 13 consist of a first portion comprising an opening through the holder from the face 18 through the face 19 including a head section 12*a*, 13*a* and a shank and bit section 12*b*, 13*b*. Together, these two sections are generally key-shaped corresponding to the head end 14*a*, 15*a* of the molded plastic keys 14, 15 and the shank-bit sections 14*b*, 15*b*. In addition, each of the recesses 12, 13 has a portion 12*c*, 13*c* which extends only partially through the holder 11 from the surface 18, terminating in spaced relation to the surface 19. Thus, the portions 12c, 13c comprise a step ledge portion of the recesses 12, 13, preferably at the head end 12a, 13a of the recess. Each of the keys 14, 15 similarly has a portion, 14c, 15c of the head 14a, 15a formed of reduced thickness. The thickness of the head portions 14c, 15c may advantageously be matched to the thickness of the portions 12c, 13c of the holder 11 such that when the reduced thickness portions are overlapped, they have a combined stack height similar to the major thickness of the holder 11 or of the keys if the keys are thicker than the holder.

Figure 4:
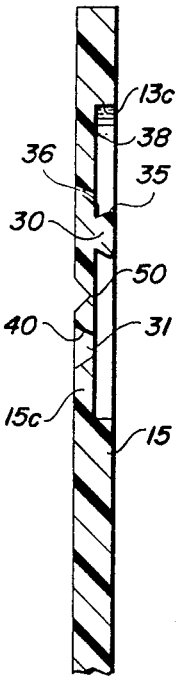
FIG. 4 is an enlarged fragmentary cross-section taken along the lines IV—IV of FIG. 1.
Figure 6:
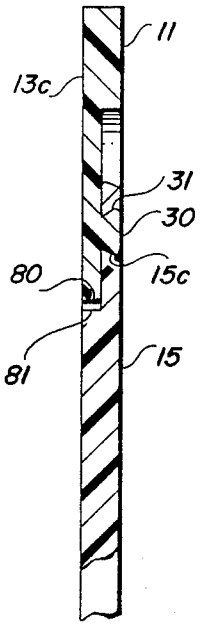
FIG. 6 is a fragmentary cross-sectional view of the key and holder snapped together taken along the lines VI—VI of FIG. 5.

Portions of the holder 11 and keys 14, 15 are formed with mating engageable snap connectors. In the preferred embodiment illustrated, each of the portions 12c, 13c is provided with a projecting male snap member 30 and portions of the keys 14, 15 are provided with corresponding female snap members 31. The male member 30, as best shown in FIG. 4, may be a bulbous headed post having an enlarged diameter free end 35 and a reduced diameter neck portion 36 at the juncture of the post with the top wall 38 of the ledge portion 13c of the recess 13. The reduced thickness portion 15c of the key 15 is formed with an opening having a frustoconical wall 44, with the frustrom of the opening dimensioned to snappingly engage the bulbous headed post as best shown in FIG. 6.

Figure 5:
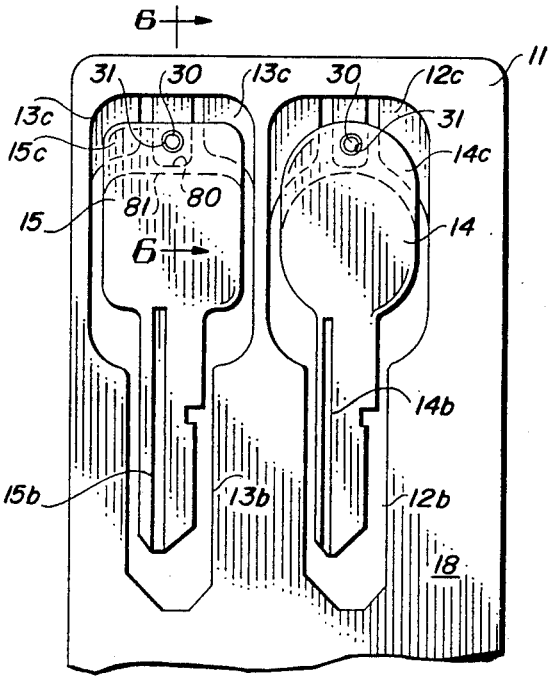
FIG. 5 is a view similar to FIG. 1 showing the keys broken from their molding condition, inverted and snapped onto the holder.

In the illustrated preferred embodiment, the key and holder may be molded together with a reduced thickness break connection 50 at a juncture of the key head and the reduced thickness portion 13c of the holder. Further, as illustrated, the portion of the reduced thickness section 13c of the holder which contains the male snap member 30 may be separated partially from the remaining parts of the portion 14c as indicated at 60. In this manner, the key and holder can be molded together, the key thereafter broken away at the break point 50, and then snapped onto the holder in partial overlap as illustrated in FIGS. 5 and 6.

In the particular embodiment illustrated, a key and card combination is illustrated having two keys such as the type used in automobiles for ignition and lock keys. In such uses, the heads of the keys are generally configured differently. If desired, the key-shaped recess can have a generally similar configuration and the key heads can be configured generally similar to the metal keys which they are designed to emulate. Moreover, as illustrated, the reduced thickness areas of the recess and the key head can maintain ledge edge mating curvatures distinguishing the recesses so that the appropriate key fits snuggly in the recess. As illustrated in FIG. 6, if desired, the edge 80 of the portion 13c of the recess may substantially mate or be closely spaced to the edge 81 of the reduced thickness area of the key. In this manner, the ledge edges can act as mating orienting members such that when the key is received over the bulbous headed post 30 in a snapped-in condition, the key will be resisted against rotational movement in the recess.

It will of course be appreciated that either the post, the opening, or both will be provided with some degree of resiliency to allow the key to be snapped onto and off of the post.

Although the overlap reduced thickness areas are capable of being dimensioned to provide a combined stack height approximately equal to the overall thickness of the holder 11, in other embodiments the stack height could be different so as to provide, for example, the thicker key and thinner card combination described in the aforementioned Donald Almblad patent.

Further, although I have shown a key that is molded at the same time as the molding of the holder, it will be appreciated that separate molding operations can be provided for the key and holder as described in the aforementioned Almblad application.

Although various materials may be chosen for their relative properties, a common material for molded plastic key and holder combinations is Delran II, a proprietary plastic available from the E. I. DuPont De Nemours Company. Further, it will be appreciated that although this application shows two keys on a holder, where the key and holder combination are used for other than automobile sets requiring two keys, a different number of keys, such as one, may be provided, in which case the holder will be fashioned with a single complementary opening.

In use, the item can be marketed with the keys still connected to the holder through the breakable joint 50, and after purchase, the key blanks can be broken off by bending the keys out of the plane of the card until the connector 50 breaks. Thereafter, the key can be cut on standard key cutting or grinding equipment and then snapped onto the card. In this manner, a lightweight plastic combination key and holder can be provided for spare or emergency usage and conveniently carried in a wallet or purse.

Although the teachings of my invention have herein been discussed with reference to specific theories and embodiments, it is to be understood that these are by way of illustration only and that others may wish to utilize my invention in different designs or applications.

I claim as my invention:

1. A molded plastic key and carrier combination comprising a card-like molded plastic carrier having top and bottom spaced apart surfaces, said carrier having a generally key-shaped recess therein, a molded plastic key blank adapted to be received in said recess, said recess having a portion thereof formed with a planar top surface substantially parallel to the carrier top surface opposed to a planar surface portion of said key and said planar surface portions provided with complementary snap connector means allowing said key to be snapped to said card and to be removed therefrom at least one of the connector means projecting outwardly from one of said planar surface portions.

2. A combination according to claim 1, wherein the snap connector means comprises a molded plastic bulbous headed post projecting from one of said surfaces and engageable with a molded opening in the other of said planar surfaces.

3. A combination according to claim 2, wherein said key blank has a head end and a projecting shank and bit portion, the head end having a portion thereof formed of reduced thickness with respect to the thickness of remaining portions of the head end, the reduced thickness portion providing one of said planar surfaces, said card having a recess portion providing the other of said planar surfaces.

4. A combination of claim 3, wherein said card recess is provided with a first recess portion having a thickness less than the thickness of the card and a second recess portion having a lesser thickness than the thickness of the first portion, whereby a step ledge is provided between the first and second portions, and one of said planar surfaces is formed on the second portion of the card.

5. A combination according to claim 4, wherein said first recess portion is an opening extending entirely through said card.

6. A combination according to claim 4, wherein said key is attachable to said card with the reduced thickness portion of the head end of the key overlapping the second recess portion of the recess and with a combined stack height of the second recess portion and the reduced thickness portion of said head being at least substantially equal to the thickness of said card in areas other than the first and second portions.

7. A combination of claim 6, wherein the stack height is the same as the thickness of the card other than in said first and second portions.

8. A combination of claim 7, wherein the head of the key has a maximum thickness substantially the same as the stack height.

9. A combination of claim 6, wherein the snap means post has a projection above the associated planar face such that when the key is snapped to the card that the thickness in the area of the snap connection is substantially equal to the stack height.

10. A key and key carrier combination comprising a molded plastic card-like key carrier having a key receiving recess molded therein, a molded plastic key blank received in said recess, a stepped ledge formed in said recess, a complementary stepped ledge formed on said key blank, and mating snapped connections formed on a surface of said recess step ledge and on an opposable surface of said key stepped ledge, said connections effective to snappingly engage the key to the carrier in a removable fashion.

11. The combination of claim 10, wherein the recess step ledge is formed adjacent one end of the recess and where the key step ledge is formed at the head end of the key, the step ledges having opposable planar surfaces, the snap connection including a projecting bulbous headed male member extending from one of said planar surfaces and a mating female member formed in the other of said planar surfaces.

12. The combination of claim 11, wherein the recess has a portion thereof extending entirely through the carrier.

13. A molded plastic key and carrier combination comprising a card-like molded plastic carrier having top and bottom spaced apart surfaces, said carrier having a generally key-shaped recess therein, a molded plastic key blank adapted to be received in said recess, said recess having a portion thereof formed with a planar top surface opposed to a planar surface portion of said key and said planar surface portions provided with complementary snap connector means allowing said key to be snapped to said card and to be removed therefrom, said snap connector means comprising a molded plastic bulbous headed post projecting from one of said planar surfaces and engageable with a molded opening in the other of said planar surfaces.

* * * * *